US008742302B2

(12) United States Patent
Lee

(10) Patent No.: US 8,742,302 B2
(45) Date of Patent: Jun. 3, 2014

(54) HEATING DEVICE AND ITS TEMPERATURE CONTROL METHOD

(76) Inventor: Shu Chiu Lee, Keelung (TW)

( * ) Notice: Subject to any disclaimer, the term of this patent is extended or adjusted under 35 U.S.C. 154(b) by 1512 days.

(21) Appl. No.: 12/314,471

(22) Filed: Dec. 11, 2008

(65) Prior Publication Data

US 2010/0051606 A1 Mar. 4, 2010

(30) Foreign Application Priority Data

Sep. 1, 2008 (TW) ..... 97133421 A

(51) Int. Cl.
*H05B 1/02* (2006.01)

(52) U.S. Cl.
USPC ..... 219/505; 219/481; 219/212; 219/492

(58) Field of Classification Search
USPC ..... 219/212, 481, 482, 492, 494, 501, 505
See application file for complete search history.

(56) References Cited

U.S. PATENT DOCUMENTS

| | | | | |
|---|---|---|---|---|
| 5,748,429 | A * | 5/1998 | Peterson | 361/106 |
| 6,703,593 | B2 * | 3/2004 | Sopory | 219/505 |
| 6,768,294 | B1 * | 7/2004 | Moldavsky et al. | 324/76.39 |
| 2005/0263518 | A1 * | 12/2005 | Weiss | 219/482 |

* cited by examiner

*Primary Examiner* — Brian Jennison
(74) *Attorney, Agent, or Firm* — Bacon & Thomas, PLLC

(57) ABSTRACT

A heating device and its temperature control method, wherein an NTC element envelops a core member, a sensing wire is wound around an outside periphery of the NTC element for making parallel connection of the core member with the sensing wire; further, a capacitor, the sensing wire and an electric resistor are connected in series to form an RC circuit, the RC circuit is connected with a microprocessor and a switch. Thereby when the microprocessor outputs a control signal containing at least a duty cycle square wave in a predetermined time to control the switch to make a direct-current electric power source electrically charge/discharge for the RC circuit; meanwhile, the microprocessor measures RC time constant of the RC circuit, and when it detects changing of the RC time constant reaches a preset state, it outputs a control signal to make the heat emitting line and the direct-current electric power source in a state of circuit turning on or off, such that the heat emitting device is kept at a predetermined working temperature.

6 Claims, 8 Drawing Sheets

HEATING DEVICE AND ITS TEMPERATURE CONTROL METHOD

FIELD OF THE INVENTION

The present invention relates to a heating device and its temperature control method, and especially to a method in which by heating of a direct-current electric power source, an RC circuit including an NTC (negative temperature coefficient) element can make an RC time constant change during the heating process because of the characteristic of the NTC element, and through detecting of a microprocessor to do heating or temperature lowering at once, the heating device can keep at a predetermined working temperature; the method is applicable to a heat emitting device such as an electric heating stove or a heating blanket etc.

BACKGROUND

Heating structures such as an electric heating blanket or a normal heating blanket have been widely used in the markets presently, for the purpose of getting an object of adjusting and controlling temperature, a PTC (positive temperature coefficient) element or an NTC element are taken as a sensing structure; the mode of using such heating structures for heating in cooperating with heat emitting lines thus is widely used.

As is depicted in FIG. 7 showing a U.S. Pat. No. 5,861,610 of which the main technical feature is to have a core "a" wound therearound with a heating conductor "a1", a second insulating layer "a2", a sensing wire "a3" and a first insulating layer "a4", the sensing wire "a3" is made of PTC material (nickel alloy). Because of the characteristic of the PTC element, when the temperature of the sensing wire "a3" is raised following heating of the heating conductor "a1", or the electric resistance of the sensing wire "a3" is changed by high temperature, a comparing circuit in a controller will do comparison, then the amount of current of the heating conductor "a1" will be adjusted according to the result of comparison, so that heat emitting temperature can be controlled within the range set by a user.

The above stated technique has been disclosed by U.S. Pat. Nos. 6,300,597, 6,310,322 and 6,768,086. We can see from the above approved patents that, it is quite popular presently to use PTC elements on the techniques of temperature controlling and detecting, such as is depicted in FIG. 8 showing a U.S. Pat. No. 7,138,611. In which a microprocessor "b" detects changing of the phase shifts of two shaping circuits "b1", "b2" at set times to control turning on/off of a triggering switch "b3", in order that a PTC element "b4" continuously heat or lower temperature, and thereby a heat emitting line can be kept within a predetermined working temperature range. Thereby heat emitting temperature of the heat emitting line can be controlled effectively to provide guarantee of safety. A U.S. Pat. No. 7,180,037 similarly detects changing of phase shift taking advantage of the characteristic of an NTC element to control the heat emitting temperature of the heat emitting line.

However, any of the above stated heat emitting structures must be input with electric current of over 100 volts to get the heating effect; hence although there is a perfect protecting circuit, danger of line damage or circuit fault can still exists, thereby people are exposed in the danger of electric shock. And when people stay outdoors or in cars, they are hard to get the alternative electric current from indoors, although they can change direct electric current to alternative electric current by an electric power inverter, the volume of the power inverter will be largely increased for the purpose of generating sufficient electric power to heat a heat emitting structure such as an electric heating blanket or a normal heating blanket. This not only is space wasting, but also is inconvenient in use.

In view of the this, and for getting rid of the above defects to make a heat emitting device and its method of temperature controlling able to perform heating with a power source using lower voltage direct current, and to make a user able to avoid electric shock and use the device conveniently; and by temperature controlling taking advantage of the characteristic of the NTC element, the effect of safety protecting can be obtained, the inventor thereby developed the present invention based on his experience of years and nonstop study as well as improvement.

SUMMARY OF THE INVENTION

The primary object of the present invention is to provide a heating device and a temperature control method, wherein by heating of a direct-current electric power source, the electric resistance of an NTC element of an RC circuit during the heating process can be changed, and a microprocessor detects the change of an RC time constant by the change of the electric resistance of the NTC element, so that the structure can keep on heating at a low temperature, and can be automatically turned off at a high temperature, thereby safety of use can be assured, and effective control on the heating temperature can be achieved.

To achieve the above stated object of the present invention, a temperature control method for a heating device provided by the present invention comprises the following steps: a. to provide a microprocessor to output a control signal containing at least a duty cycle square wave in a predetermined time for electrically charging/discharging for a resistance-capacitor (RC) circuit with an NTC (negative temperature coefficient) element; b. to heat the NTC element with a core member to change the RC time constant of an RC circuit; and c. during the process of heating, to use the microprocessor to detect changing of the time constant at set times for outputting a control signal, so that the core member and the direct-current electric power source are in a state of circuit turning on or off.

The heating device provided by the present invention comprises a heat emitting line, a capacitor, a switch and a microprocessor. Wherein the heat emitting line includes a core member, an NTC element and a sensing wire; the NTC element envelops the core member, the sensing wire is wound around the outside periphery of the NTC element for providing electric resistance for the NTC element, and for making parallel connection of the core member with the sensing wire; the capacitor, the sensing wire and an electric resistor are connected in series to form an RC circuit, a direct-current electric power source is connected with one end of the RC circuit; the switch is connected with the electric power source, and is connected with another end of the RC circuit in a mode to be in a state of circuit turning on or off with the direct-current electric power source; the microprocessor is connected with the switch for outputting a control signal containing at least a duty cycle square wave in a predetermined time; and the microprocessor is connected with the RC circuit for detecting changing of an RC time constant at set times for outputting a control signal, so that the heat emitting line and the direct-current electric power source are in the state of circuit turning on or off, such that the heat emitting device is kept at a predetermined working temperature.

The present invention will be more apparent after reading the detailed description of the preferred embodiments thereof in reference to the accompanying drawings.

BRIEF DESCRIPTION OF THE DRAWINGS

FIGS. 6-6C are schematic views showing change of the RC time constant of an RC circuit of the present invention.

DETAILED DESCRIPTION

Figure 1:
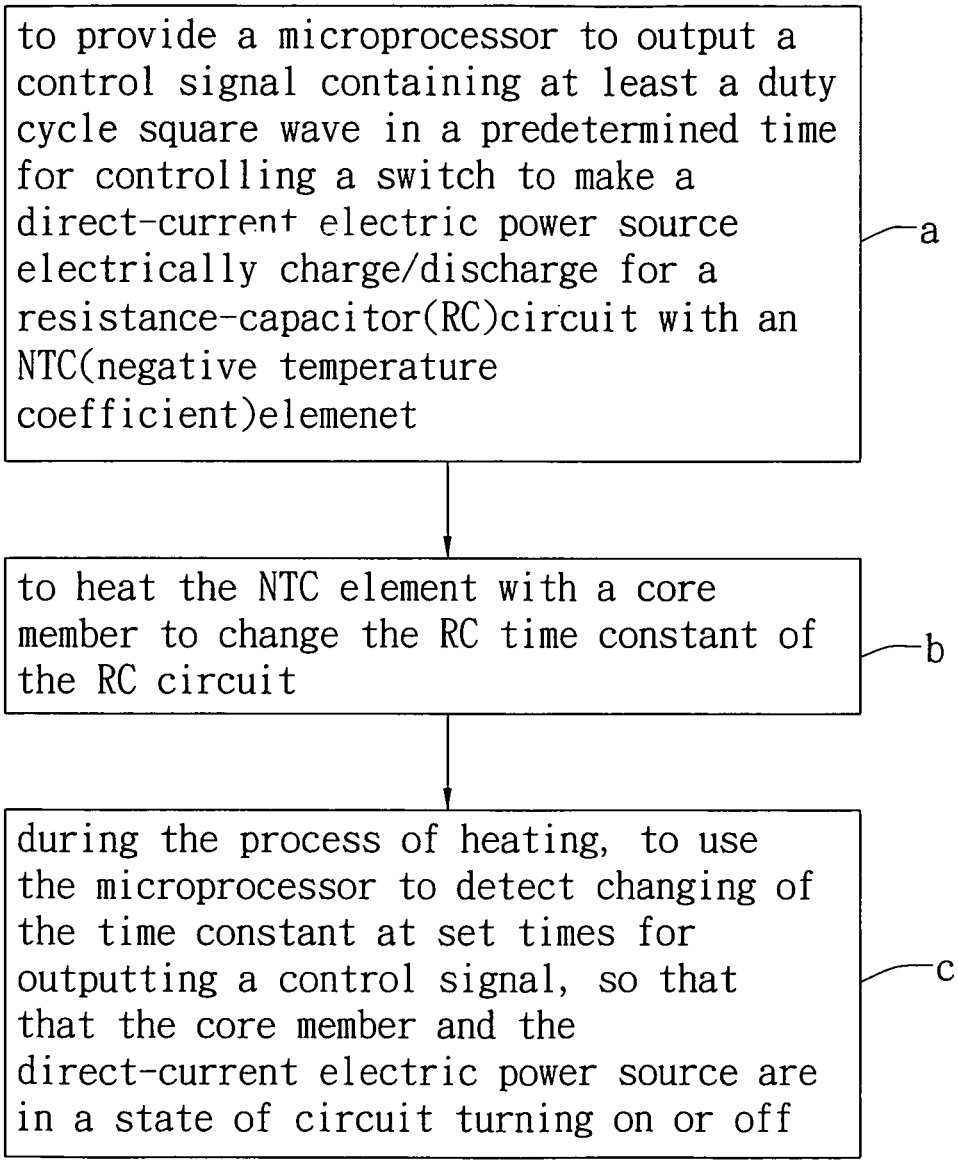
FIG. 1 is a flow chart of the temperature controlling method for a heat emitting device of the present invention.
Figure 2:
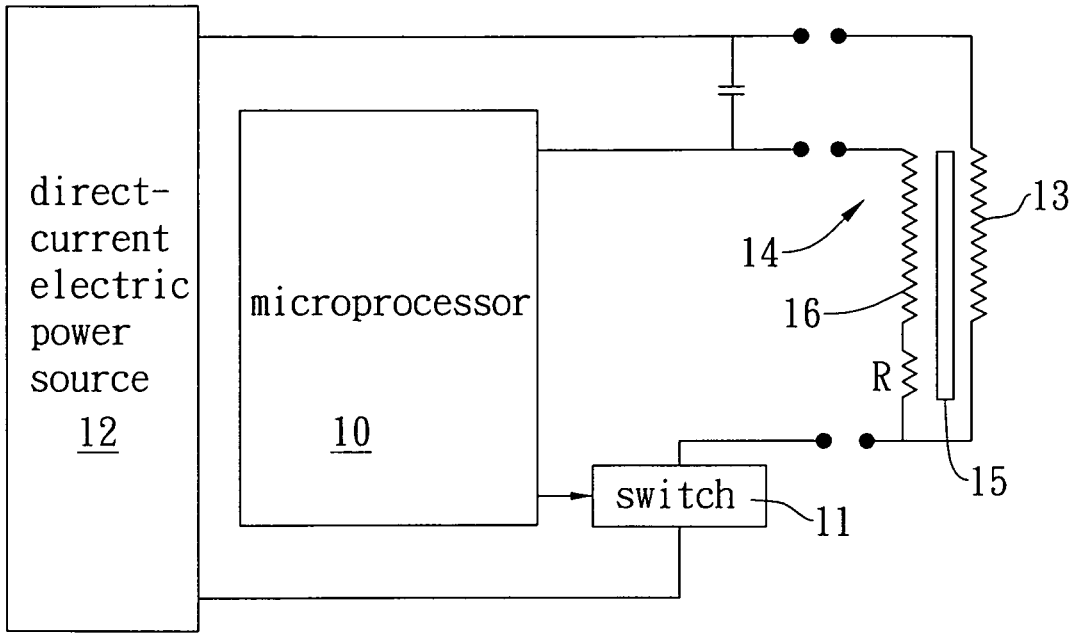
FIG. 2 is a schematic block diagram showing the circuit of the present invention.

Referring to FIGS. 1 and 2, the temperature control method for the heat emitting device of the present invention comprises the following steps:

a. providing a microprocessor 10 to output a control signal containing at least a duty cycle square wave in a predetermined time for controlling a switch 11 to make a direct-current electric power source electrically charge/discharge for a resistance-capacitor (RC) circuit 14 with an NTC (negative temperature coefficient) element 15;

b. heating the NTC element 15 with a core member 13 to change the RC time constant of the RC circuit 14; and c. during the process of heating, using the microprocessor 10 to detect changing of the time constant at set times for outputting a control signal, so that the core member 13 and the direct-current electric power source 12 are in a state of circuit turning on or off.

Figure 3:
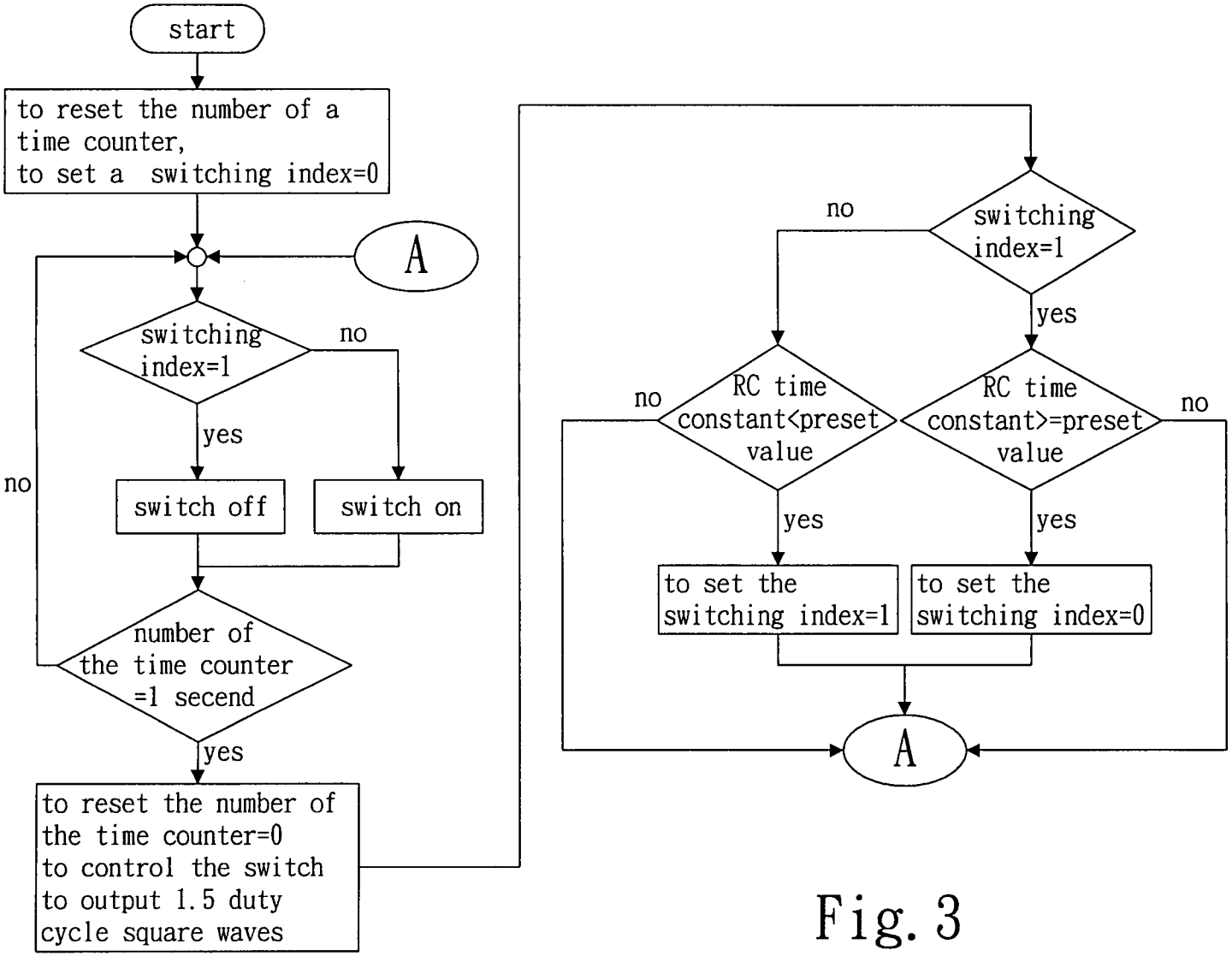
FIG. 3 is a flow chart showing heating and temperature controlling of the present invention.

Referring to FIGS. 2, 3, the present invention is further specified in its heating and temperature control method taking a lower-voltage direct-current electric power source 12 with a voltage of 12 V (volts) as an example. Firstly, the microprocessor 10 sets the number of a time counter at 0 and then starts counting, and sets a switching index (indicating whether it is in the state of heating) at 0 and then makes the direct-current electric power source 12 heat the core member 13; meanwhile, the microprocessor 10 continuously outputs a control signal containing 1.5 (50%) duty cycle square waves of which a duty cycle is 4 ms (milliseconds) and a 5 volt high level voltage within one second for controlling the switch 11 to electrically charge/discharge for the resistance-capacitor (RC) circuit 14, thereby the microprocessor 10 measures the RC time constant till the switching index is changed to 1; wherein the microprocessor 10 also can output one or more than one duty cycle square waves to control the switch 11.

In the above steps, the switch 11 is shown being turned on in order that the direct-current electric power source 12 normally and continuously heats the core member 13 in 1 second; when the counting value of time equals to one second, that is, after one second continuous heating, the microprocessor 10 will set the number of a time counter at 0 and then restarts counting for the next 1 second, and output another control signal containing 1.5 duty cycle square waves of which a duty cycle is 4 ms (milliseconds) and a 5 volt high level voltage in the meantime, such that the direct-current electric power source 12 electrically charges/discharges the resistance-capacitor (RC) circuit 14, and makes the microprocessor 10 measure the RC time constant, after that, the detecting work is done once every second, if the switching index keeps on being at 0, heating is kept on.

During the process of heating, the core member 13 continuously heats the NTC element 15 of the (RC) circuit 14 to raise the temperature of a heat emitting line 16. When the NTC element 15 has its resistance reduced by rising of temperature, the RC time constant of the resistance-capacitor (RC) circuit 14 is shortened. If the value of the RC time constant detected by the microprocessor 10 is larger than or equal to a preset value, the switching index will still be 0, the core member 13 is kept on being heated; while if the value of the RC time constant is smaller than the preset value, the switching index will still become 1, the microprocessor 10 outputs a control signal containing 1.5 duty cycle square waves of which a duty cycle is 4 ms (milliseconds) and a 0 volt low level voltage for controlling the switch 11 to make the core member 13 and the direct-current electric power source 12 be in the state of circuit turning off. When the core member 13 is no more heated, the electric resistance of the NTC element 15 will be gradually increased by cooling of temperature, and the RC time constant will be changed, when the RC time constant value equals to the preset value, the switching index will become 0, the process of heating will be restarted. Thereby, the process of heating can be kept on at a low temperature, and can be automatically broken at a high temperature, thus the temperature of heating can be controlled within a predetermined range.

Figure 4:
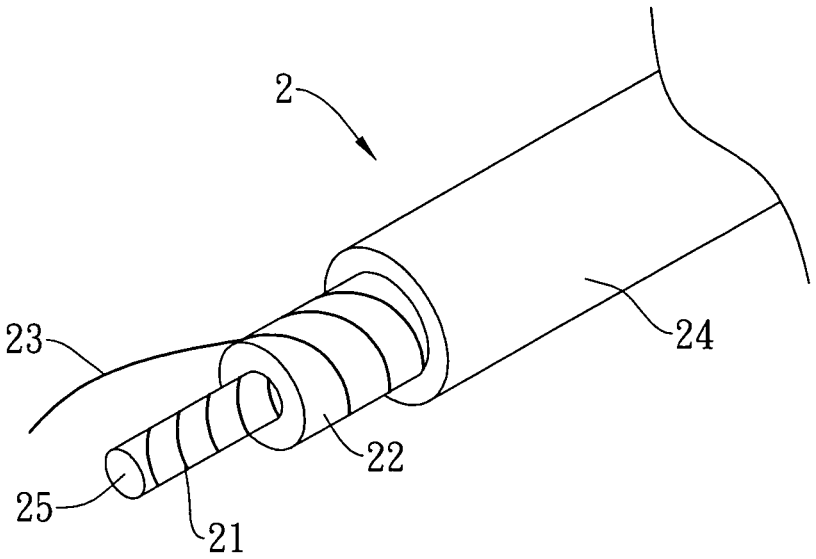
FIG. 4 is a perspective view showing the appearance of a heat emitting line of the present invention.
Figure 5:
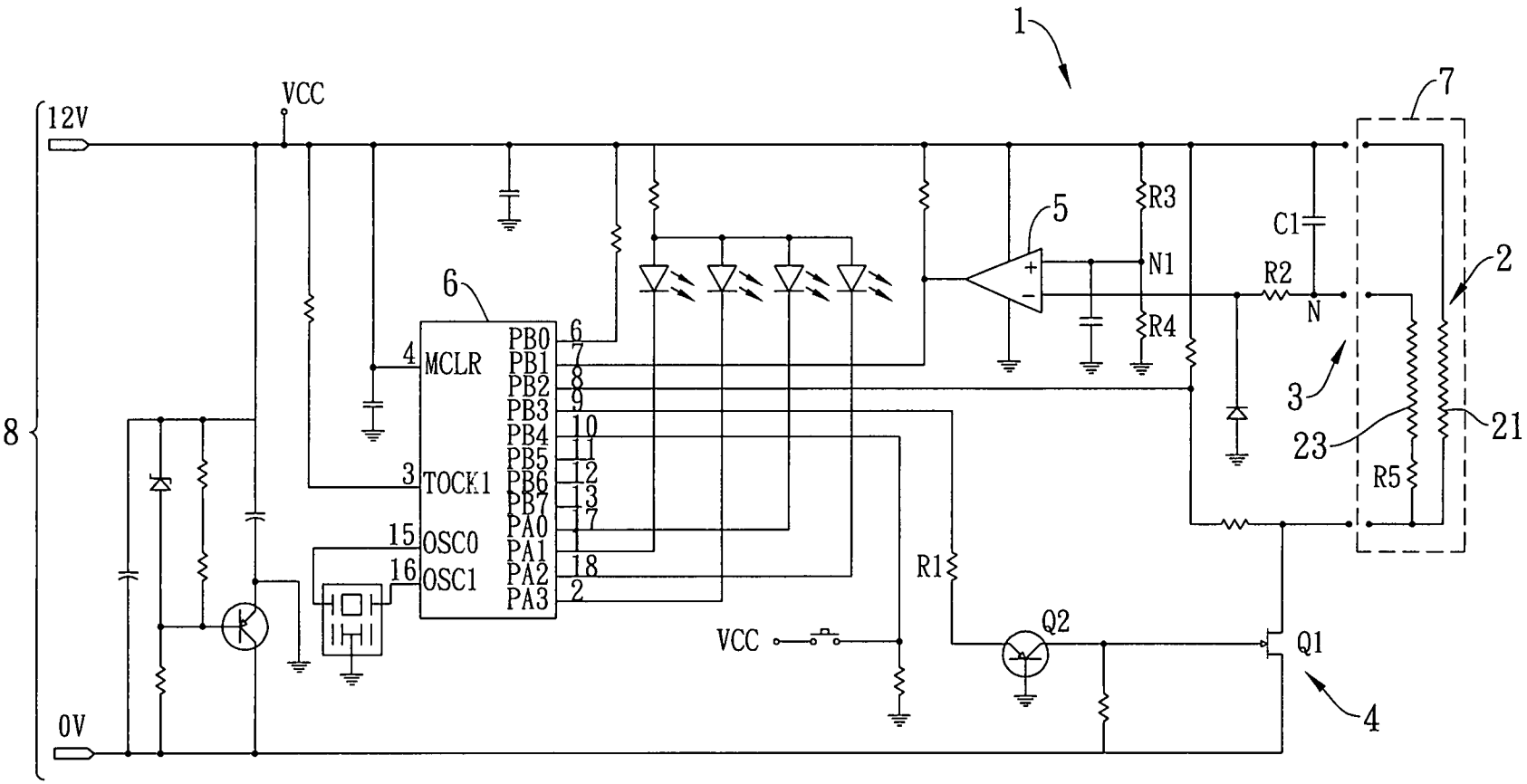
FIG. 5 is a circuit diagram of the heat emitting device of the present invention.

Referring to FIGS. 4 and 5 showing a preferred embodiment of the heating device 1 of the present invention, the device 1 comprises a heat emitting line 2, an RC circuit 3, a switch 4, a comparator 5 and a microprocessor 6. The heat emitting line 2 is received in a bag 7 to be used as an electric heating blanket, and the comparator 5 can also be built in the microprocessor 6.

The heat emitting line 2 includes a core member 21, an NTC (negative temperature coefficient) element 22, a sensing wire 23 and a coating layer 24. The core member 21 is wound around the outside periphery of a fiber line 25, the NTC element 22 completely wraps the core member 21, the sensing wire 23 is a conductor of low resistance and is wound around the outside periphery of the NTC element 22 (as is shown in FIG. 4) for sensing the resistance of the NTC element 22.

The sensing wire 23 is serially connected with an electric resistance R5 and a capacitor C1 to form the RC circuit 3, and the RC circuit 3 is parallelly connected with the core member 21, one end of the RC circuit 3 is connected to a positive end of a direct-current electric power source 8, the other end of the RC circuit 3 is connected to the switch 4; in the present embodiment, the switch 4 is a field-effect transistor (being called shortly as FET) Q1, the other end of the RC circuit 3 is connected to a drain electrode of the FET Q1, a source electrode of the FET Q1 is directly connected to the negative end of an electric power source 8, and the gate of the FET Q1 is connected to a $9^{th}$ pin of the microprocessor 6 through a PNP transistor Q2 and a resistance R1.

A node N is provided between the capacitor C1 of the RC circuit 3 and an inverse input terminal, the non-inverse input terminal of the comparator 5 is connected to a node N1 between two resistances R3, R4 for inputting direct current divisional voltage, while the output terminal of the comparator 5 is connected to a $7^{th}$ pin of the microprocessor 6.

Figures 6A, 6B, 6C:
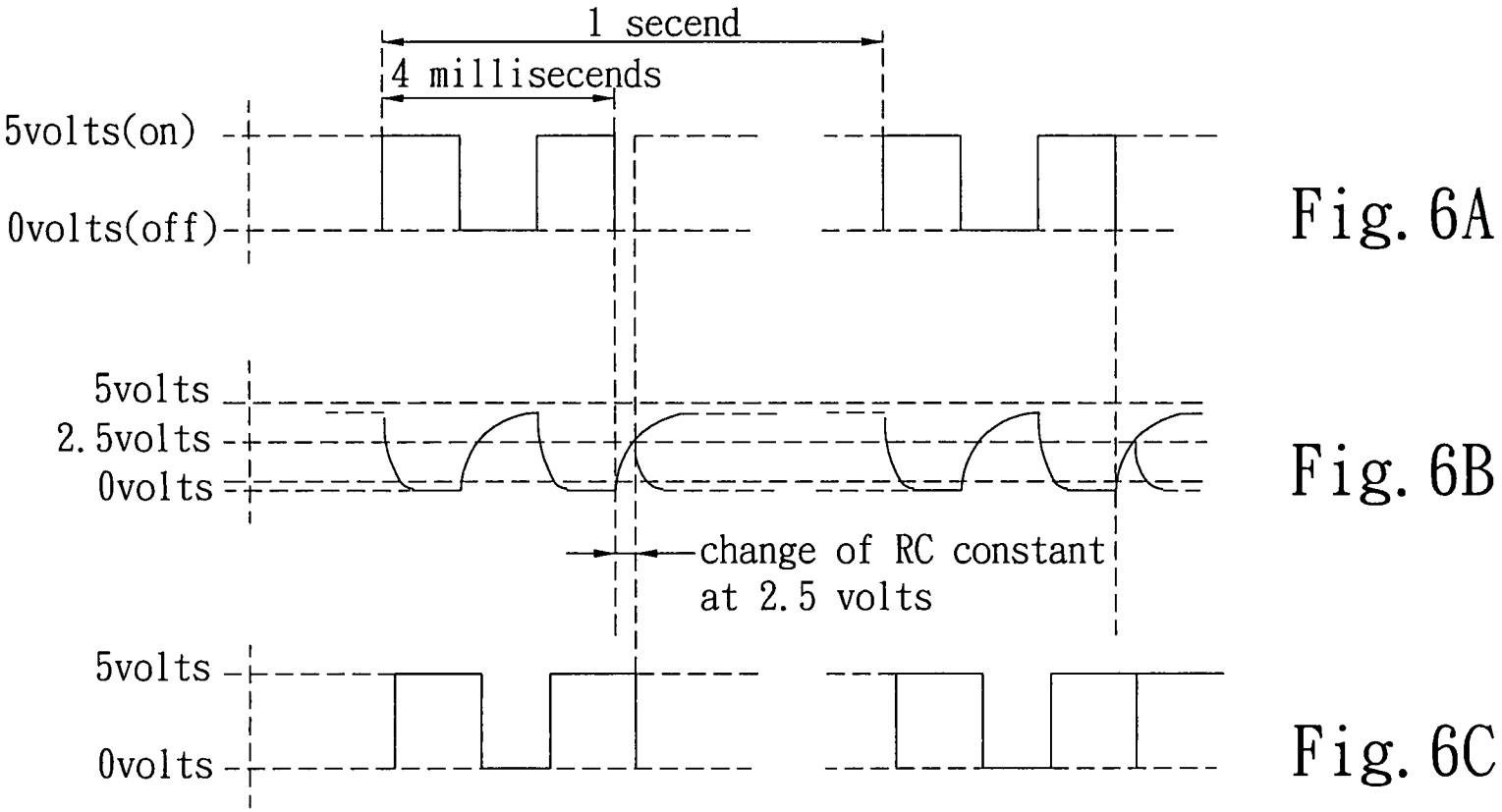
Figure 7:
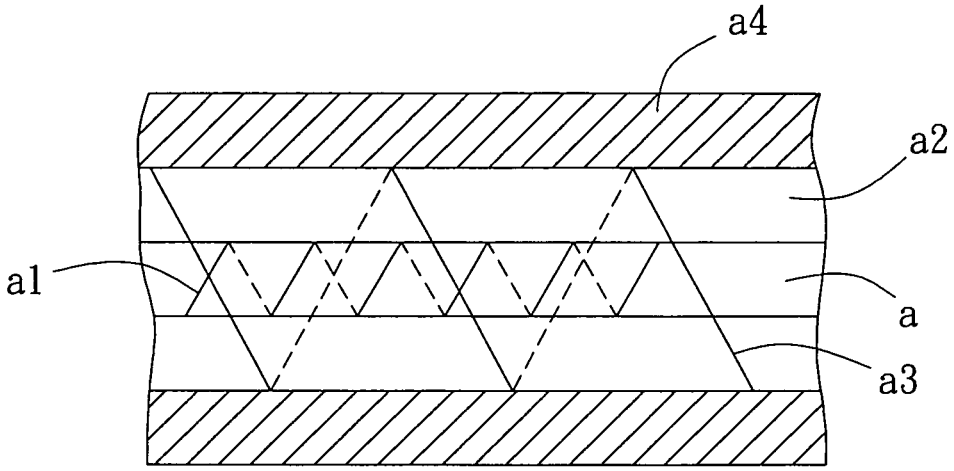
Fig. 7(Prior Art)
FIG. 7 is a sectional view showing the combination of a prior art U.S. Pat. No. 5,861,610.
Figure 8:
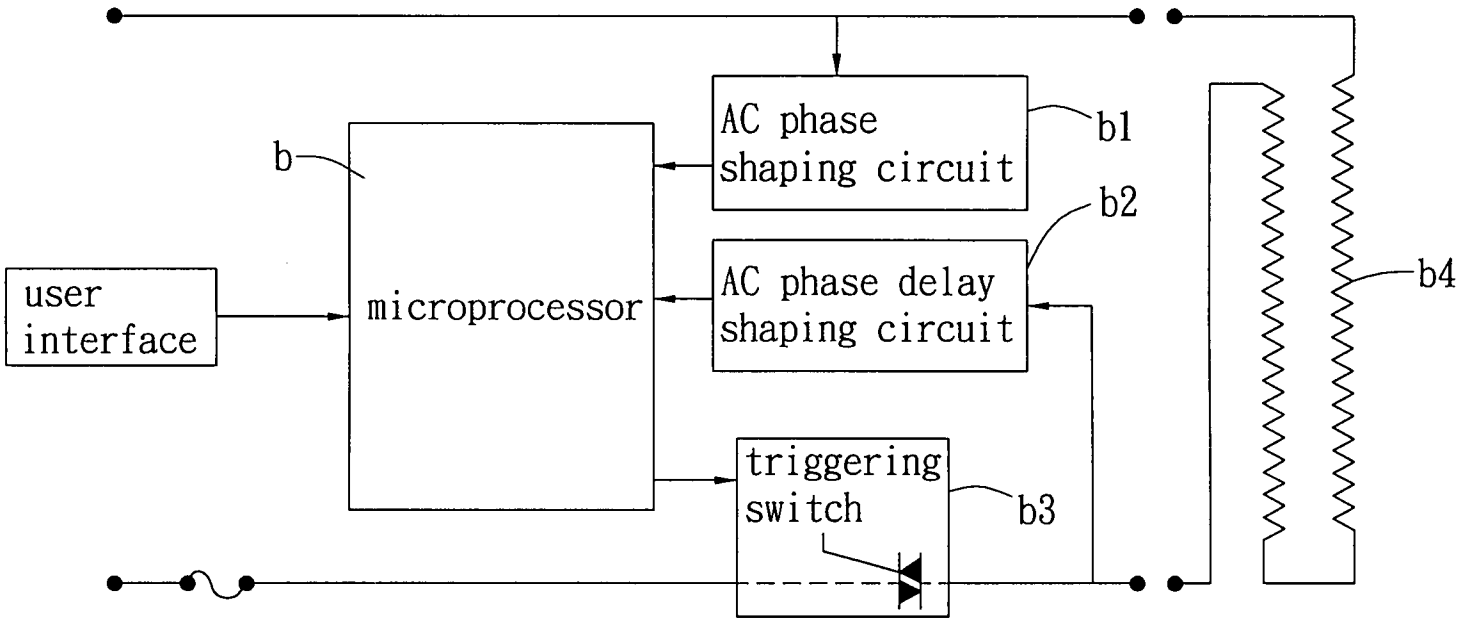
Fig. 8(Prior Art)
FIG. 8 is a schematic block diagram showing a circuit of a prior art U.S. Pat. No. 7,138,611.

When in heating, the microprocessor 6 outputs a control signal containing 1.5 duty cycle square waves of which a duty cycles is 4 ms (milliseconds) and a 5 volt high level voltage (as shown in FIG. 6A) to the gate of the FET Q1 via the PNP transistor Q2, in order that the direct-current electric power source 8 electrically charges/discharges for the RC circuit 3 taking one second as a unit.

When the drain electrode of the FET Q1 is on, so that the direct-current electric power source 8 and the heat emitting line 2 are in a state of circuit turning on, the capacitor C1 starts charging, and when the FET Q1 is off, the capacitor C1 discharges and outputs from the node N, hence the voltage at the inverse input terminal of the comparator 5 is raised. In this embodiment, because the direct current divisional voltage output from the non-inverse input terminal of the comparator 5 is preset as a constant voltage of 2.5 volts, when the voltage at the non-inverse input terminal of the comparator 5 is raised to be over 2.5 volts, the electric potential at the output terminal of the comparator 5 will be transferred from a high level H1 to a low level LO; when in inputting to the $7^{th}$ pin of the microprocessor 6, the time of charging by discharging with 2.5 volts from the capacitor C1 can be calculated, thereby the amount of changing of an RC time constant of the RC circuit 3 by reducing of the electric resistance of the NTC element 22 during the state of heating can be obtained (as shown in FIGS. 6A~6C). Similarly, when temperature is lowered, the RC time constant of the RC circuit 3 will increase by increasing of the electric resistance of the NTC element 22, and the amount of changing of the RC time constant similarly will be input to the microprocessor 6.

In which when the value of the RC time constant of the RC circuit 3 is smaller than the preset value, the microprocessor 6 outputs a control signal containing 1.5 duty cycle square wave of which a duty cycles is 4 ms (milliseconds) and a 0 volt low level voltage every second, in order that the heat emitting line 2 and the direct-current electric power source 8 are in a state of circuit turning off; when the microprocessor 6 once more detects that the RC time constant is larger than or equals to the preset time, the microprocessor 6 once more outputs a control signal to heat the core member 21 to get the object of temperature controlling.

Therefore, the present invention has the following advantages:

1. The present invention can perform heating process with a low voltage direct-current electric power source, it not only is convenient for use in various fields, but also can assure safety in use.

2. The present invention can detect the changing of an RC time constant by changing of the electric resistance of an NTC element to control increasing or lowering of temperature of a heat emitting line, thereby a working temperature can be controlled within a predetermined range.

In conclusion, according to the above stated content, the present invention surely can get the expected object thereof to provide a heat emitting device and its temperature control method that not only can perform heating with a low voltage direct-current electric power source, and can avoid electric shock and make convenient use, and can control temperature by the feature of an NTC element to get an effect of safety and protection; hence the present invention has its extremely high industrial value. Having thus described my invention, what I claim as new and desire to be secured by Letters Patent of the United States is:

What is claimed is:

1. A temperature control method for a heating device which comprises a heat emitting line, a capacitor, a switch, and a microprocessor, where the heat emitting line includes a core member, a negative temperature coefficient (NTC) element and a sensing wire, the NTC element the NTC element wraps the core member, the sensing wire is wound around an outside periphery of the NTC element; the capacitor is serially connected with the sensing wire to form a resistance-capacitor (RC) circuit, one end of the RC circuit is connected with a direct-current electric power source; the switch is connected to the direct-current electric power source and the RC circuit; the microprocessor is connected with the switch and the RC circuit; the temperature control method comprising:

a. using the microprocessor to output a control signal containing at least a duty cycle square wave in a predetermined time for controlling the switch to make the direct-current electric power source electrically charge/discharge for the RC circuit with the NTC element;

b. heating the NTC element with the core member connected with the direct-current electric power source to decrease the resistance of the NTC element, so as to change an RC time constant of the RC circuit; and c. during processing of heating, using the microprocessor to detect changing of the RC time constant of the RC circuit at set times and to output a control signal by the microprocessor when the RC time constant reaches a value predetermined by the microprocessor, so that the core member and the direct-current electric power source are in a state of circuit turning on or off.

2. A heating device comprising:

a heat emitting line including a core member, a NTC element and a sensing wire, the NTC element the NTC element wraps the core member, the sensing wire is wound around an outside periphery of the NTC element for sensing resistance of the NTC element, the core member is parallelly connected with the sensing wire;

a capacitor serially connected with the sensing wire and an electric resistance to form an RC circuit, one end of the RC circuit is connected to an end of a direct-current electric power source;

a switch connected to the direct-current electric power source, and connected with another end of the RC circuit in a mode to be in a state of circuit turning on or off with the direct-current electric power source; and a microprocessor connected with the switch for outputting a control signal containing at least a duty cycle square wave in a predetermined time; the microprocessor is connected with the RC circuit for detecting changing of an RC time constant at set times, so that the heat emitting line and the direct-current electric power source are in a state of circuit turning on or off.

3. The heating device as in claim 2, wherein the switch is an FET (field-effect transistor), a source electrode of the RC circuit is connected to the direct-current electric power source, a drain electrode of the FET is connected to another end of the RC circuit, and a gate of the FET is connected to the microprocessor.

4. The heating device as in claim 2, wherein the heating device has a bag to receive the heat emitting line.

5. The heating device as in claim 2, wherein a node is provided between the capacitor of the RC circuit and an inverse input terminal, and the node is connected to the microprocessor.

6. The heating device as in claim 5, wherein the heating device further comprises a comparator, a non-inverse input terminal of the comparator is connected to another node between two resistances for inputting direct current divisional voltage, the direct current divisional voltage is a constant voltage, and an inverse input terminal of the comparator is connected to the another node while an output terminal of the comparator is connected to the microprocessor.

* * * * *